US010744049B2

(12) United States Patent
Naber et al.

(10) Patent No.: US 10,744,049 B2
(45) Date of Patent: Aug. 18, 2020

(54) PATIENT TRANSFER APPARATUS

(71) Applicant: Stryker Corporation, Kalamazoo, MI (US)

(72) Inventors: Brandon Naber, Portage, MI (US); William Ross Heneveld, Jr., Portage, MI (US); Christopher Hough, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 130 days.

(21) Appl. No.: 15/855,161

(22) Filed: Dec. 27, 2017

(65) Prior Publication Data

US 2018/0185213 A1 Jul. 5, 2018

Related U.S. Application Data

(60) Provisional application No. 62/441,026, filed on Dec. 30, 2016.

(51) Int. Cl.
*A61G 5/06* (2006.01)
*A61G 7/10* (2006.01)

(52) U.S. Cl.
CPC ..... *A61G 5/061* (2013.01); *A61G 5/066* (2013.01); *A61G 7/1073* (2013.01)

(58) Field of Classification Search
CPC ..... A61G 5/066
See application file for complete search history.

(56) References Cited

U.S. PATENT DOCUMENTS

| | | | | |
|---|---|---|---|---|
| 2,931,449 A | | 4/1960 | King | |
| 3,195,910 A | | 7/1965 | Steiner | |
| 4,044,850 A | * | 8/1977 | Winsor | A61G 5/045 180/9.26 |
| 4,136,888 A | * | 1/1979 | Bowie, Jr. | A61G 5/066 280/47.25 |
| 5,868,403 A | * | 2/1999 | Culp | A61G 5/061 280/5.22 |

(Continued)

FOREIGN PATENT DOCUMENTS

| | | |
|---|---|---|
| CA | 2746194 C | 10/2014 |
| CN | 204915772 U | 12/2015 |

(Continued)

OTHER PUBLICATIONS

English language abstract and machine-assisted English translation for CN 204915772 extracted from espacenet.com database on Jun. 6, 2018, 14 pages.

(Continued)

*Primary Examiner* — Kevin Hurley
(74) *Attorney, Agent, or Firm* — Howard & Howard Attorneys PLLC

(57) ABSTRACT

A patient transfer apparatus includes a seat assembly, a track assembly coupled to the seat assembly and including a track configured to engage the stairs in a stair traversing position, and front wheels coupled to the seat assembly for engagement with a floor in a transport position. The seat assembly includes a frame and a seat for supporting a patient. A front end of the track assembly is adjacent the front wheels without interfering with movement of the wheels in the transport position.

20 Claims, 9 Drawing Sheets

(56) References Cited

U.S. PATENT DOCUMENTS

| | | | | |
|---|---|---|---|---|
| 6,648,343 | B2 * | 11/2003 | Way | A61G 5/061 280/250.1 |
| 6,805,209 | B2 * | 10/2004 | Hedeen | A61G 5/061 180/9.32 |
| 6,857,490 | B2 * | 2/2005 | Quigg | A61G 5/061 180/9.28 |
| 7,950,673 | B2 * | 5/2011 | Reed | A61G 5/061 180/8.2 |
| 8,061,460 | B2 | 11/2011 | Scheck | |
| 8,307,473 | B1 * | 11/2012 | Lambarth | A61G 5/066 5/81.1 R |
| 8,371,403 | B2 | 2/2013 | Underwood | |
| 8,640,798 | B2 | 2/2014 | Walkingshaw et al. | |
| 8,720,616 | B2 | 5/2014 | Kofoed et al. | |
| 9,004,204 | B2 | 4/2015 | Walkingshaw et al. | |
| 9,486,373 | B2 | 11/2016 | Lambarth et al. | |
| 9,510,981 | B2 | 12/2016 | Lambarth et al. | |
| 2013/0081885 | A1 | 4/2013 | Connor | |
| 2013/0274973 | A1 | 10/2013 | Kamara et al. | |
| 2014/0021006 | A1 | 1/2014 | Kamara et al. | |
| 2015/0251713 | A1 | 9/2015 | Couture et al. | |
| 2016/0176453 | A1 | 6/2016 | Rudakevych | |
| 2017/0035628 | A1 | 2/2017 | Naber et al. | |
| 2017/0079859 | A1 | 3/2017 | Lambarth et al. | |
| 2018/0028377 | A1 | 2/2018 | Stryker et al. | |
| 2018/0028383 | A1 | 2/2018 | Stryker et al. | |
| 2019/0350782 | A1 * | 11/2019 | Wang | B62D 55/084 |

FOREIGN PATENT DOCUMENTS

| | | | |
|---|---|---|---|
| GB | 2429192 | A | 2/2007 |
| JP | 5878877 | B2 | 3/2016 |

OTHER PUBLICATIONS

English language abstract for JP 5878877 extracted from espacenet.com database on Jun. 6, 2018, 2 pages.

Addady, Michael, "This Wheelchair is Like a Segway Crossed with a Tank, and it Can Climb Stairs", Oct. 19, 2015, article and video downloaded from http://fortune.com/2015/10/19/wheelchair-climb-stairs/, 2 pages.

Bouckley, Hanna, "The Wheelchair That Can Travel Up Stairs", 2016, downloaded from http://home.bt.com/tech-gadgets/tech-news/the-wheelchair-that-can-travel-up-stairs-11364035427656, 2 pages.

Gomes, Carlos, "Using LabVIEW and MyRIO, We Created a Wheelchair That Can Improve the Lives of Disabled People and Give Them the Mobility Everyone Deserves", 2016, Case Study and Video downloaded from http://sine.ni.com/cs/app/doc/p/id/cs-16829, 2 pages.

Robo Rats, "Robo-Rats Locomotion: Differential Drive", Apr. 4, 2001, downloaded from https://groups.csail.mit.edu/drl/courses/cs54-2001s/diffdrive.html, 2 pages.

The Gadget Flow, "SCEWO Stair Climbing Wheelchair", 2017, downloaded from https://thegadgetflow.com/portfolio/scewo-stair-climbing-wheelchair/, 3 pages.

Topchair France, "Photo of Stair-Climbing Wheelchair" 2015, downloaded from http://www.topchair.fr/wp-content/uploads/2015/07/Topchair-S-fauteuil-electrique-escalier-e1453809380620.jpg, 1 page.

Topchair, "Topchair-S Stair-Climbing Wheelchair User Guide", May 2014, 54 pages.

U.S. Appl. No. 15/854,943, filed Dec. 27, 2017.

Promeba, S.L., "Promeba Emergency & Rescue-Chair PS-250/Power Track PA-260/Support PA-270 Catalog", http://promeba.com/wp-content/uploads/2017/05/Cataleg_Promeba_PS-250_v01_BR.pdf, Jan. 2017, 16 pages.

amazon.com, "LINE2 Design Battery Powered Track Stair Chair 70019-Y-BAT Heavy Duty Emergency Lightweight Portable Folding Evacuation Chair", 2019, https://www.amazon.com/LINE2design-70019-Y-BAT-Emergency-Lightweight-Evacuation/dp/B07MDHF4CP, 8 pages.

Mobile Stairlift, "Mobile Stairlift & Accessories Webpage", 2019, https://www.mobilestairlift.com/products/mobile-stairlift-battery-powered-portable, 4 pages.

Mobile Stairlift, "Mobile Stairlift Motorized Chair Lift—Battery Powered Webpage", 2019, https://www.mobilestairlift.com/collections/mobile-stairlift-accessories, 5 pages.

Youtube, "How to Use the Mobile Stairlift Dolly—An Introductory Guide Video", Apr. 10, 2018, https://www.youtube.com/watch?v=BQt3-q73Zyg, 2 pages.

Youtube, "Introducing the Mobile Stairlift—Portable Stair Climbing Wheelchair Video", Apr. 10, 2018, https://www.youtube.com/watch?v=QhBhuuoeyd4, 3 pages.

Youtube, "ST003A PLUS New Type Mobility Stair Climber Chair for Lifting Elderly Video", Apr. 5, 2018, https://www.youtube.com/watch?v=_ItZ1Nbpf-0, 2 pages.

* cited by examiner

PATIENT TRANSFER APPARATUS

CROSS-REFERENCE TO RELATED APPLICATION

This application claims the benefit of U.S. provisional application Ser. No. 62/441,026 filed on Dec. 30, 2016, which is hereby incorporated by reference in its entirety.

BACKGROUND

Patient transfer apparatuses (e.g., stair chairs, stretchers, wheelchairs, etc.) may be adapted to transport patients up or down an incline, such as stairs. In many instances, it may be difficult or impossible for individuals to travel up or down stairs on their own. In situations where stairs are the only viable option to navigate between floors, such as outdoor staircases or buildings without elevators, patient transfer apparatuses may be employed. These allow one or more operators to move a patient up or down stairs in a safe and controlled manner.

Patient transfer apparatuses may make use of a track that contacts the stairs, supporting at least a portion of the weight of the patient and allowing the patient transfer apparatus to transition between stairs. This track may be deployed by moving it backwards, away from the apparatus. In the deployed position, the track may occupy a significant amount of space, which may present challenges in moving the apparatus through confined spaces.

BRIEF DESCRIPTION OF THE DRAWINGS

The exemplary embodiments will become more fully understood from the following detailed description, taken in conjunction with the accompanying drawings, wherein like reference numerals refer to like elements, in which.

DETAILED DESCRIPTION

Figure 1:
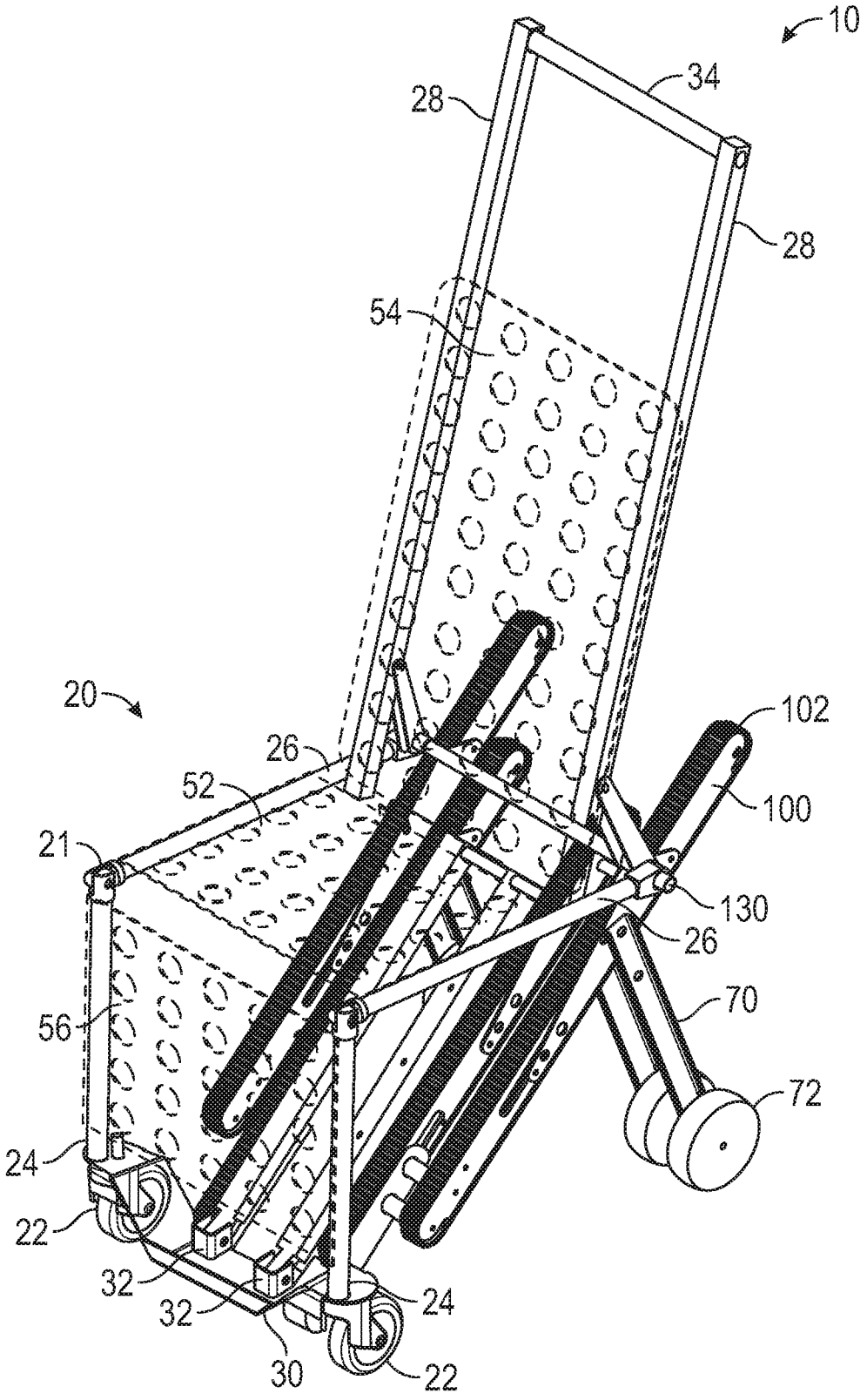
FIG. 1 is a perspective view of a patient transfer apparatus, according to an exemplary embodiment.

A patient transfer apparatus is configured to be controlled by an operator to traverse a set of stairs while supporting a patient. According to various exemplary embodiments, the patient transfer apparatus includes a seat assembly, a track assembly, and a set of supports. The seat assembly includes a frame including a seat, a lower leg rest, and a seat back and is configured to support a patient. The track assembly is coupled to the seat assembly and, in some exemplary embodiments, located partially under the seat. In some embodiments, the track is configured to be driven by a motor. A set of wheels is coupled to the front end of the frame, and another set of wheels is coupled to the distal end of each of the rear supports. When supporting the patient on level ground or a substantially smooth incline, a set of rear supports, such as rear legs, are oriented such that all of the wheels touch the ground. When traversing a set of stairs, the rear legs rotate relative to the frame such that the track under the seat contacts the stairs without interference from the rear supports. Integration of the track under the seat is intended to result in a significant space savings. Further, the design presented in various embodiments described herein places the patient directly above the tracks, which results in a greater degree of apparatus stability during transport and a lesser degree of apparatus incline during stair transport. In this way, the seat assembly and the patient maintain a more level position (relative to the ground) during stair transport.

Referring to FIGS. 1-4, an exemplary embodiment of a patient transfer apparatus is shown as patient transfer apparatus 10. Patient transfer apparatus 10 includes a seat assembly 20, rear supports 70, and a track assembly 100 including tracks 102 and 104. The seat assembly 20 includes a frame 21. Wheels 22 (front wheels) are coupled to the seat assembly 20 for engagement with a level floor or a substantially smooth incline (i.e., a support surface) in a transport position. The wheels 22 are rotatably coupled to the front end portion of the frame 21, and wheels 72 are coupled to the distal ends of the rear supports 70. Track assembly 100 and rear supports 70 are coupled to the seat assembly 20. In some embodiments, the track assembly is coupled to the frame 21. The rear supports 70 are coupled to at least one of the track assembly 100 and seat assembly 20. In some embodiments, the rear supports 70 are coupled directly to the frame 21. In other embodiments, the rear supports 70 are indirectly coupled to the frame 21 through the track assembly 100. Although the illustrated embodiment depicts two rear supports 70, the apparatus 10 may include fewer or more than two. In some embodiments, the patient transfer apparatus 10 includes a control system 200 (depicted in FIG. 9) including a power source 205, a controller 210, and a control interface 280. In some embodiments, the tracks 102 and 104 are driven by one or more motors.

According to exemplary embodiments as shown in the figures, the frame 21 includes lower members 24, seat members 26, and back members 28. In some embodiments, the members 24 and 26 and the members 26 and 28 are pivotably coupled together. In other embodiments, some of the members 24, 26, and 28 may be rigidly coupled (e.g., by welding, using fasteners, using adhesive, etc.). According to the exemplary embodiment shown in FIGS. 1-4, the members 24, 26, and 28 are made with material having a tubular cross section. In other embodiments, the members 24, 26, and 28 are made with material having various cross sections (e.g., square tube, round tube, solid, etc.) in various configurations (e.g., a different number of members, members in different positions, etc.). In the illustrated embodiment, the frame 21 is pivotably coupled to the track assembly 100 at a frame base member 30, which is further coupled to members 26. In one embodiment, the track assembly 100 is pivotably coupled to front and rear ends of the seat assembly 20. Frame base member 30 includes brackets 32 to pivotably couple the track assembly 100 to the frame 21. In the embodiment shown, the wheels 22 are coupled to frame base member 30. In the illustrated embodiment, wheels 22 are caster wheels that can rotate about two axes, which allows the front end of the apparatus 10 to translate freely on flat ground.

In the illustrated embodiment, a seat 52, a seat back 54, and a lower leg rest 56 are coupled to the frame 21. In one embodiment, seat 52 supports a patient and is coupled to seat members 26; seat back 54 is coupled to back members 28; and lower leg rest 56 is coupled to lower members 24. The seat 52 is pivotable relative to the tracks 102, 104. As shown in the illustrated embodiment of FIGS. 1-3, the seat 52, seat back 54, and lower leg rest 56 are all made from pieces of flat sheet. In other embodiments, the seat 52, seat back 54, and lower leg rest 56 are otherwise formed. By way of example, the seat 52 may be formed using foam to maximize patient comfort and support. By way of another example, the lower leg rest 56 may be formed to include depressions to hold the legs of the patient. By way of another example, the seat back 54 may include mounting points for straps to secure the patient.

Figure 2:
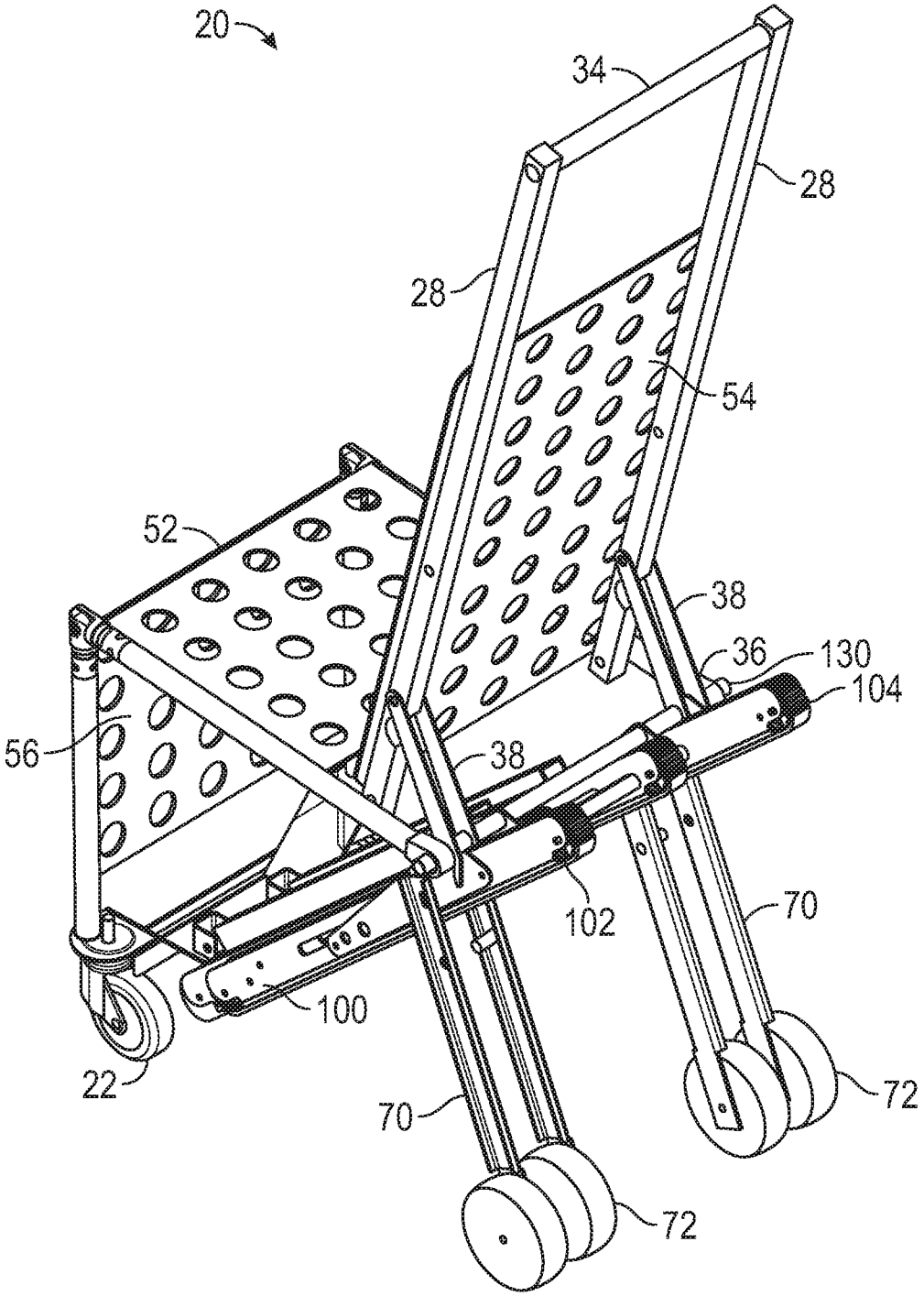
FIG. 2 is a rear perspective view of the patient transfer apparatus of FIG. 1.
Figure 3:
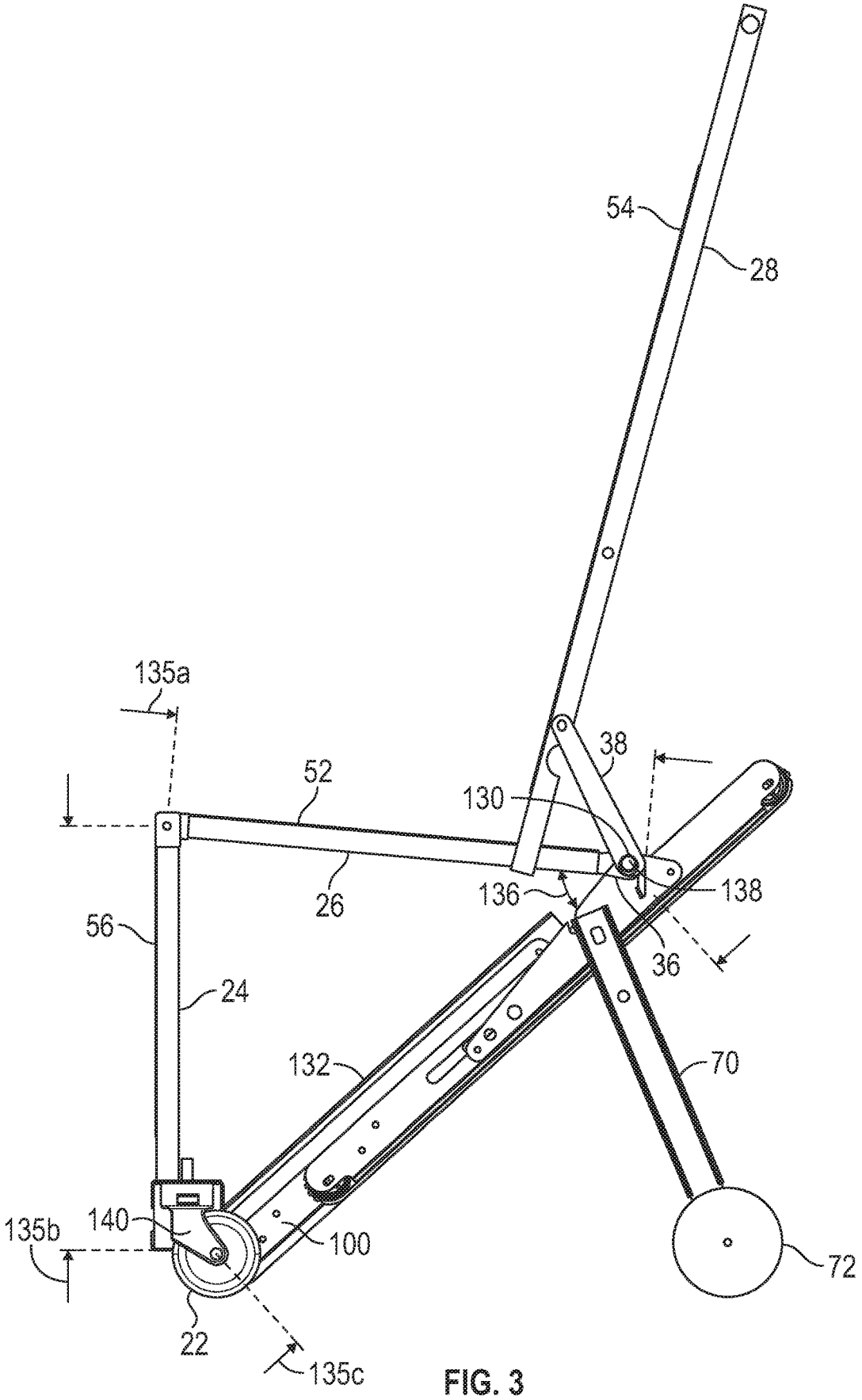
FIG. 3 is a side view of the patient transfer apparatus of FIG. 1.

Referring to FIGS. 2 and 3 of the illustrated embodiment, the frame 21 of seat assembly 20 is pivotably coupled to the track assembly 100 at eyes 36. In one embodiment, the eyes 36 are rigidly coupled to the seat members 26. Apertures in eyes 36 are configured to receive therethrough cross member 130 of the track assembly 100 (described in greater detail below). Back supports 38 provide upright support of the back 54. In the illustrated embodiment, back supports 38 are also pivotably coupled to the track assembly 100 via cross member 130, and coupled to the back members 28. In the illustrated embodiment, near the top end of the back members 28 is a handle 34 which can be used by the operator to manipulate (e.g., push, pull, etc.) the apparatus 10. In some embodiments, the frame 21 includes handles attached to the front and rear ends of the apparatus 10 to facilitate carrying and manipulating the apparatus 10. In some embodiments, the handles attached to the front and rear ends of the apparatus 10 are translatably coupled or pivotably coupled to the rest of the frame 21 such that they can be deployed or extended for use.

Referring still to FIG. 2, the rear supports 70 are pivotably coupled to the track assembly 100. In some embodiments, the rear supports 70 are directly coupled to the frame 21. In other embodiments, the rear supports 70 are indirectly coupled to the frame 21 through the track assembly 100 as shown in FIG. 2. Each wheel 72 is rotatably coupled to the distal end of the respective rear support 70. In some embodiments, the wheel 72 can only rotate relative to the rear support 70 about one axis. This allows the operator to tilt the apparatus 10 about the wheels 72 and raise the front end of the apparatus 10 in a dollying configuration. With the apparatus 10 in the dollying configuration, the operator can push or pull the apparatus 10 so the front wheels move above a small step or curb. The operator can then lift the rear end of the apparatus 10 and move the rear end over the curb. Configuring the wheels 72 to only rotate in one axis increases stability and control when in a dollying configuration as compared to caster wheels. Configuring the wheels 22 as caster wheels while configuring the wheels 72 to rotate only about one axis allows the apparatus 10 to turn about the rear end, enabling the operator to easily maneuver the apparatus 10. In other embodiments, the wheels 72 are caster wheels.

In one embodiment, the rear supports 70 are moveable relative to the seat assembly 20 between the transport position and the stair traversing position such that the rear supports 70 engage the floor (i.e., support surface) in the transport position to support the apparatus 10 as it moves across the floor. The support surface includes a surface that is generally flat and/or planar. In some embodiments, the rear supports 70 are pivotable relative to the frame 21 between a transport position and a stair-traversing position. In the transport position, shown in FIGS. 1-4, the rear supports 70 support the patient transfer apparatus 10 on a level floor or a substantially smooth incline (i.e., a support surface). In the stair-traversing position, shown in FIG. 5, the rear supports 70 move away from the stairs to permit the tracks 102, 104 to engage the stairs and support the apparatus 10 on the set of stairs (i.e., a support surface). In one embodiment, the rear supports 70 move above a bottom surface of the track assembly 100. The tracks 102, 104 are configured to engage the stairs in a stair traversing position. In some embodiments, the rear supports 70 include a stop to limit the rotation of the rear supports 70 from moving beyond a certain point (e.g., an extension of the rear supports 70 that contacts the track assembly 100 in a certain orientation, etc.). In some embodiments, the rear supports 70 are selectively repositionable manually (e.g., the rear supports 70 include a brake that can be selectively engaged, etc.). In yet other embodiments, the rear supports 70 are biased to move in one direction by a biasing force (e.g., a spring).

In the illustrated embodiment, the track assembly 100 is coupled to a front end of the seat assembly 20 such that at least a portion of the track assembly 100 is disposed under the seat 52. In some embodiments, the track assembly 100 is positioned below the seat 52 and at an angle relative to the seat 52. It reduces the overall dimensions of the apparatus 10, facilitating maneuvering in small spaces and allows the apparatus 10 to be stored in a compact volume. Additionally, it places the center of gravity of the patient directly above the track assembly 100, which increases the stability of the apparatus 10 while traversing the set of stairs.

Figure 5:
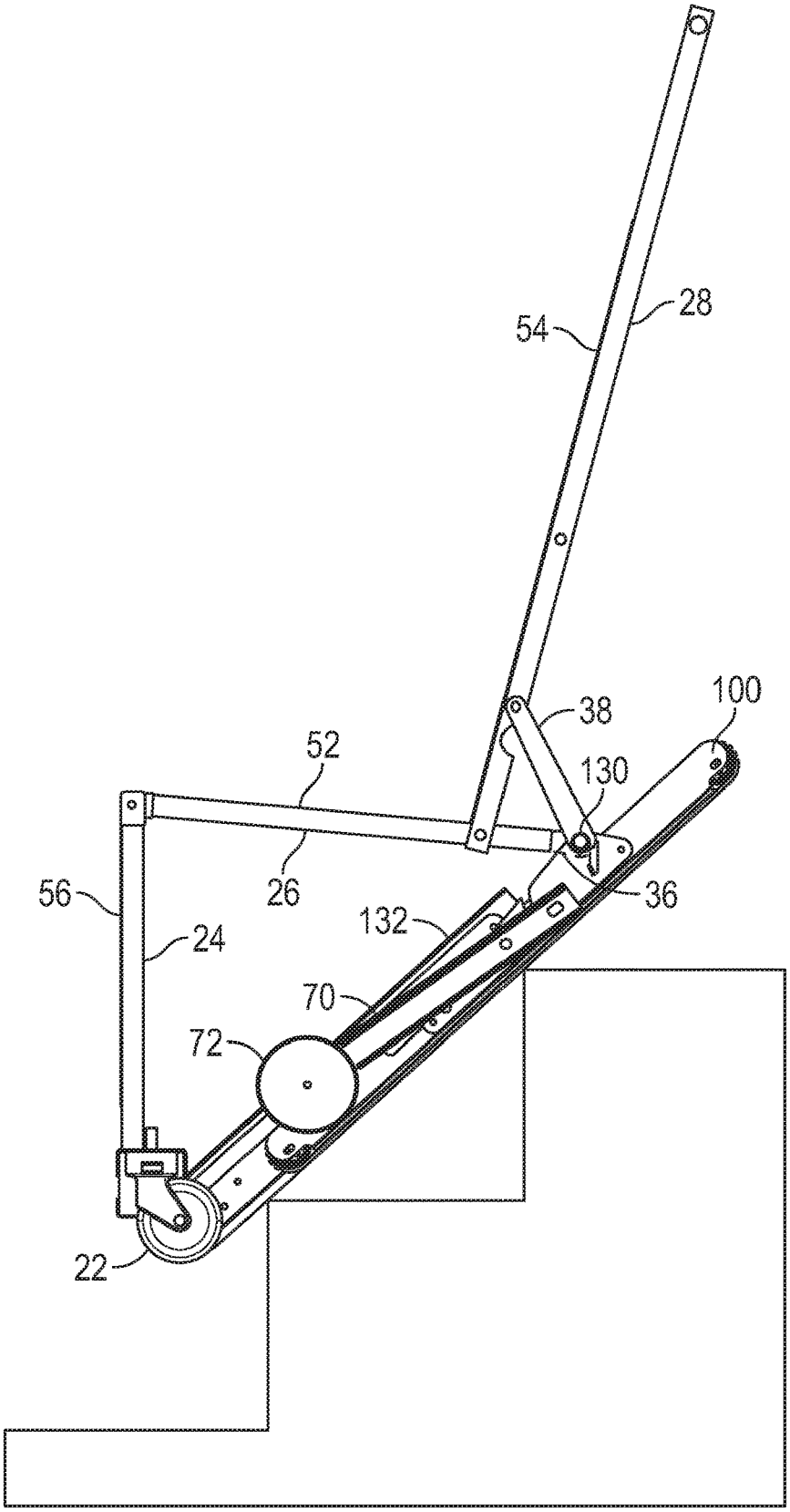
FIG. 5 is a side view of the patient transfer apparatus of FIG. 1 in a first configuration on a set of stairs, according to an exemplary embodiment.
Figure 6:
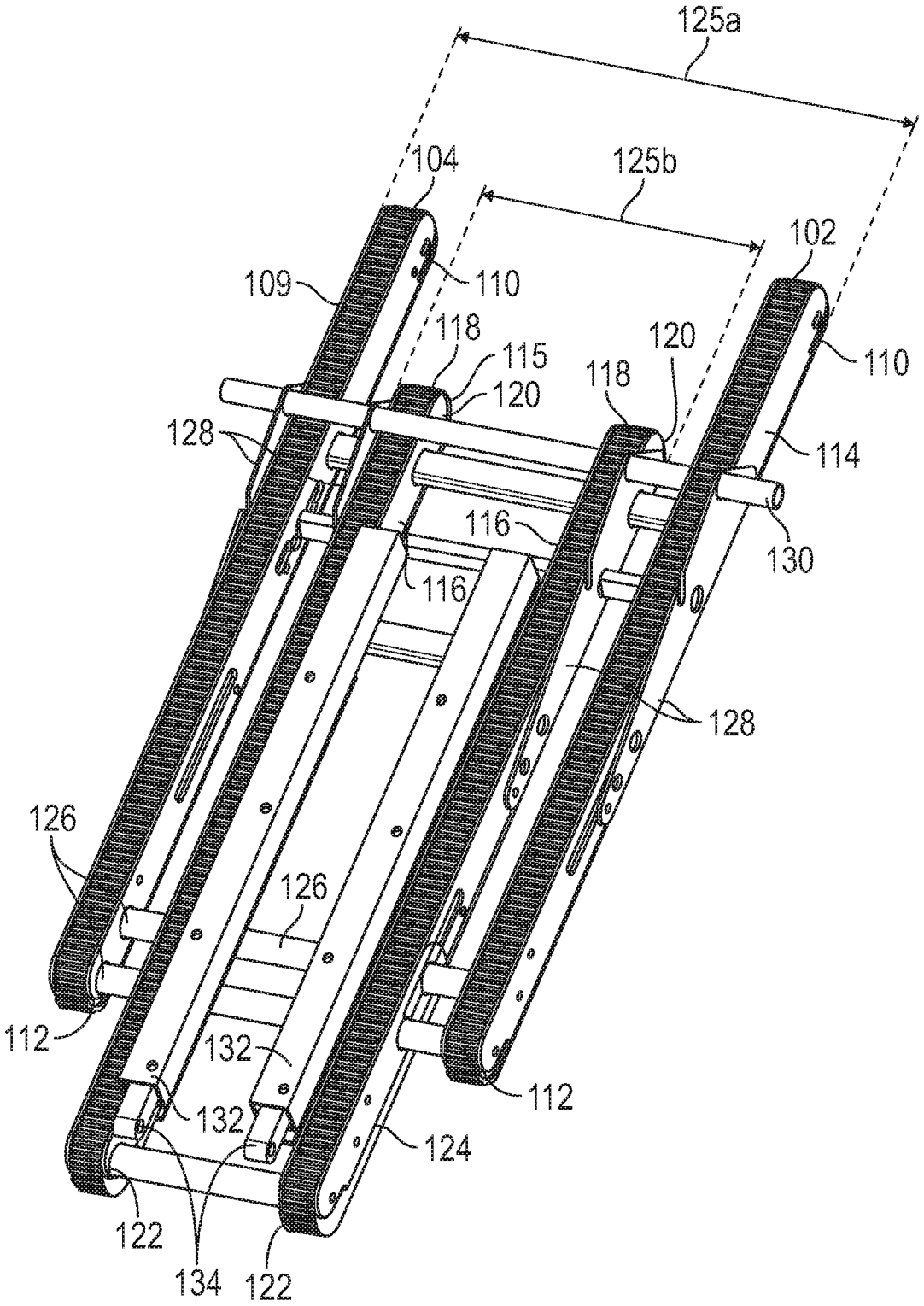
FIG. 6 is a top perspective view of a track assembly of the patient transfer apparatus of FIG. 1, according to an exemplary embodiment.
Figure 7:
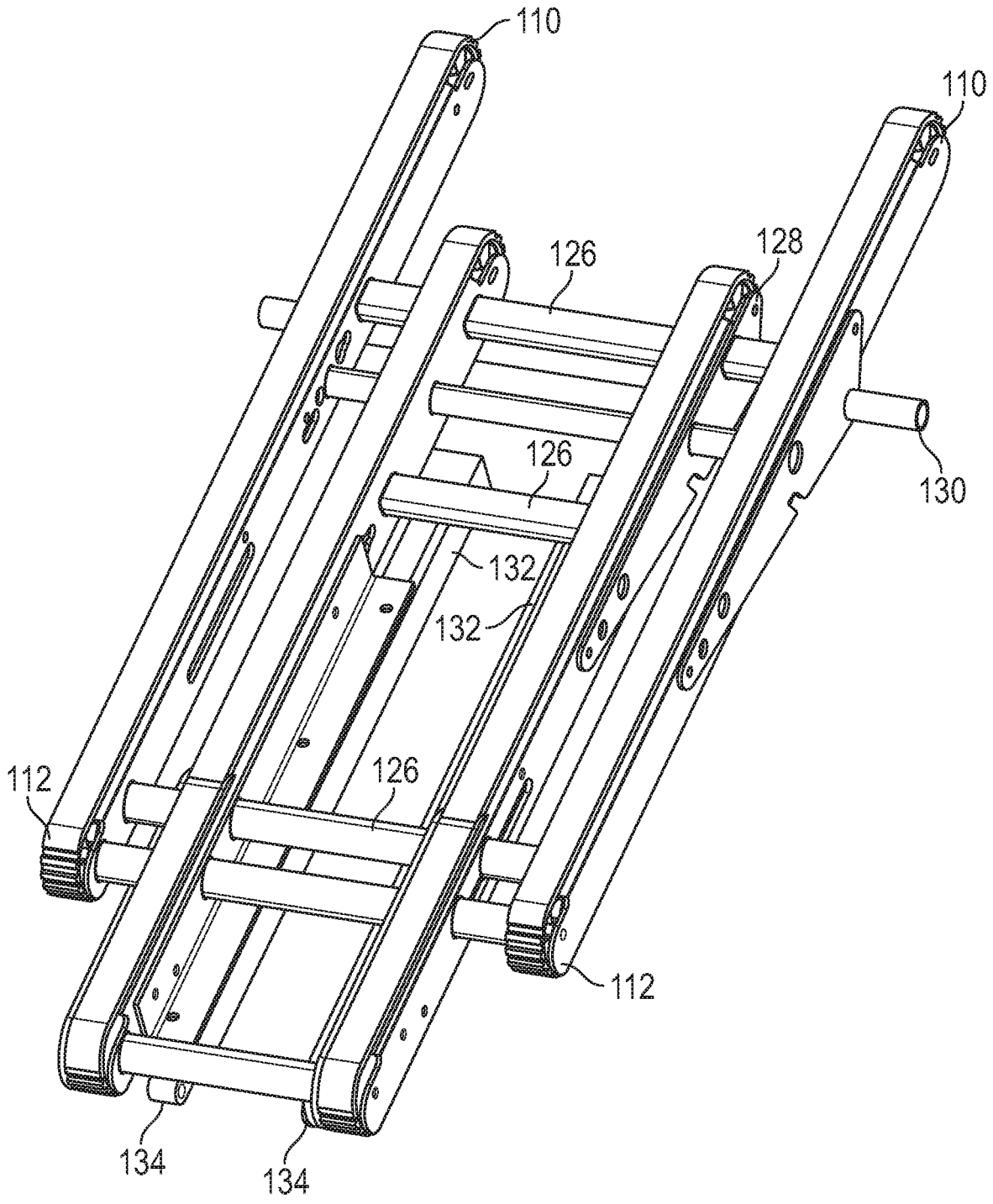
FIG. 7 is a bottom perspective view of the track assembly of FIG. 6.

While traversing the set of stairs, the track assembly 100 supports the apparatus 10 on the stairs, and the tracks 102 and 104 act as tractive elements on the stairs. As shown in FIG. 5, the tracks 102 and 104 contact the tread edges of each of the stairs while traversing and provide a smooth transition between each of the stairs. Referring to FIGS. 6 and 7 of the illustrated embodiment, the track assembly 100 includes the track 102 and the track 104, positioned parallel to one another at a separation distance. A greater separation distance between the tracks 102 and 104 increases the stability of the apparatus 10 in the side-to-side direction. In one embodiment, top pulleys 110 and bottom pulleys 112 are rotatably coupled to track members 114. Each track 102 and 104 may be supported by a top pulley 110 and a bottom pulley 112. In some embodiments, the tracks 102 and 104, the top pulleys 110, and the bottom pulleys 112 include a means for preventing slippage between the pulleys 110 and 112 and the tracks 102 and 104 (e.g., a timing belt pattern on the interior surface of the tracks 102 and 104 and a corresponding timing belt pattern on the circumference of the pulleys 110 and 112, etc.). In some embodiments, one or both of the top pulley 110 and the bottom pulley 112 are selectively slidably coupled to the track member 114 in order to facilitate tensioning the tracks 102 and 104. Although the illustrated embodiment depicts two pulleys for each track, the track assembly 100 may include fewer or more pulleys in other embodiments.

In one embodiment, at least a portion of the track is positioned under the seat at an angle relative to the seat in the transport position. To position most of the track assembly 100 under the seat 52, the tracks 102, 104 may be shortened or spaced narrowly to permit the wheels 22, if configured as caster wheels, to rotate 360 degrees. However, spacing the tracks 102 and 104 narrowly lessens the side-to-side stability when traversing the stairs. Additionally, it is desirable that the track assembly 100 maintain at least a minimum length such that at any point in time while traversing the set of stairs the track assembly 100 supports the apparatus over at least two stairs. If the minimum length is not maintained, the apparatus could experience a loss of stability when the track assembly 100 is only supported by one stair. Configuring the wheels 22 or wheels 72 as caster wheels provides optimal maneuverability, and having caster wheels in the front of the apparatus 10 further allows wheels 72 to be used in a dollying configuration, as described above.

Accordingly, adding a second stage 116 of the track assembly 100 permits an increased length of the track assembly 100 available to contact the stairs while also providing the space for wheels 22 to swivel 360 degrees. In one embodiment, a front end of the track assembly is adjacent the front wheels 22 without interfering with movement of the wheels 22 in the transport position. In this exemplary embodiment, tracks 102 and track 104 make up a first stage 109. In one embodiment, a separation distance of the second stage 116 is less than the separation distance of the first stage 109. At least a portion of the second stage 116 may be between the pair of tracks 102, 104. In other embodiments, the second stage 116 is disposed outside a length of the first stage. Referring to FIGS. 6 and 7 of the illustrated embodiment, the second stage 116 of the track assembly 100 includes two tracks 118 positioned parallel to one other at a second separation distance smaller than the separation distance between the track 102 and track 104. In one embodiment, at least a portion of the second stage 116 is positioned between the wheels 22 in at least one position (transport position and/or stair traversing position). A span of tracks 118 is small enough that the wheels 22 can spin completely around without contacting the tracks 118. According to the exemplary embodiment shown in FIG. 6, the tracks 118 are supported by a top pulley 120 and a bottom pulley 122, both rotatably coupled to a track member 124. In some embodiments, the second stage 116 includes sets of rollers rotatably coupled to the track assembly 100 (e.g., to track member 124) such that the rollers contact the stairs when traversing the set of stairs. In some embodiments, the second stage 116 includes skis that slide across the stairs. The length of the second stage 116 may vary in other embodiments. The angle between the second stage 116 and the tracks 102 and 104 may vary in other embodiments (e.g., parallel, 10 degrees offset, 30 degrees offset, etc.). The distance between tracks 118 may also vary in other embodiments. In another embodiment, the tracks 118 may be embodied as a single track (not illustrated) located between tracks 102 and 104. With reference to FIG. 6, in some embodiments, a span 125*a* of the first stage 109 may be greater than a span 125*b* of the second stage 116.

As shown in FIGS. 6 and 7 of the illustrated embodiment, the second stage 116 extends beyond the first stage of tracks 102 and 104 in at least one position, which increases the overall length of the track assembly 100 while still allowing it to remain primarily underneath the seat 52. In this embodiment, the track assembly 100 is long enough to support the patient transfer apparatus 10 across at least two stairs throughout the process of traversing the set of stairs, ensuring stability throughout the traversing process. Additionally, as shown in the exemplary embodiment in FIG. 5, the second stage 116 extends far enough to prevent the wheels 22 from contacting the stairs.

Referring again to FIGS. 6 and 7 in the illustrated embodiment, the track members 114 and 124 are coupled together using horizontal members 126. In the illustrated embodiment, plates 128 are coupled to the sides of each of the track members 114 with the cross member 130 running through an aperture in each of the plates 128. Referring back to FIG. 2 in the illustrated embodiment, cross member 130 pivotably couples the track assembly 100 to the eyes 36 and the back supports 38 of the frame 21. Outer telescoping members 132 are coupled to the second stage 116 (e.g., by means of an angle bracket as shown in FIG. 7). In other embodiments, the outer telescoping members 132 are otherwise attached to the track assembly 100. In the illustrated embodiment, inner telescoping members 134 are translatably coupled to the outer telescoping members 132 and pivotably coupled to brackets 32 (FIG. 1) of frame base member 30. As the inner telescoping members 134 translate relative to the outer telescoping members 132, the distance between the cross member 130 (where the seat couples to the track assembly) and the brackets 32 (where the lower leg rest couples to the track assembly) changes. This causes the lower leg rest 56 to pivot relative to the seat 52 and the seat 52 to rotate relative to the track assembly 100. Thus, extending or retracting the inner telescoping member 134 relative to the track assembly 100 adjusts the angle of the seat 52 relative to the tracks 102 and 104, which adjusts the position and orientation of the patient relative to the set of stairs.

In some embodiments, the first and second stages are pivotably coupled to the seat assembly 20 such that the first and second stages pivot together relative to the seat assembly 20. In other embodiments, the first and second stages pivot independently of one another. In some embodiments, the first and second stages are rigidly coupled to one another. In other embodiments, an end of the second stage (opposite the end of the stage that is pivotably coupled to a front end of the seat assembly 20) may be translatably or pivotably coupled to the first stage such that the first and second stages move independently of one another.

Figure 8:
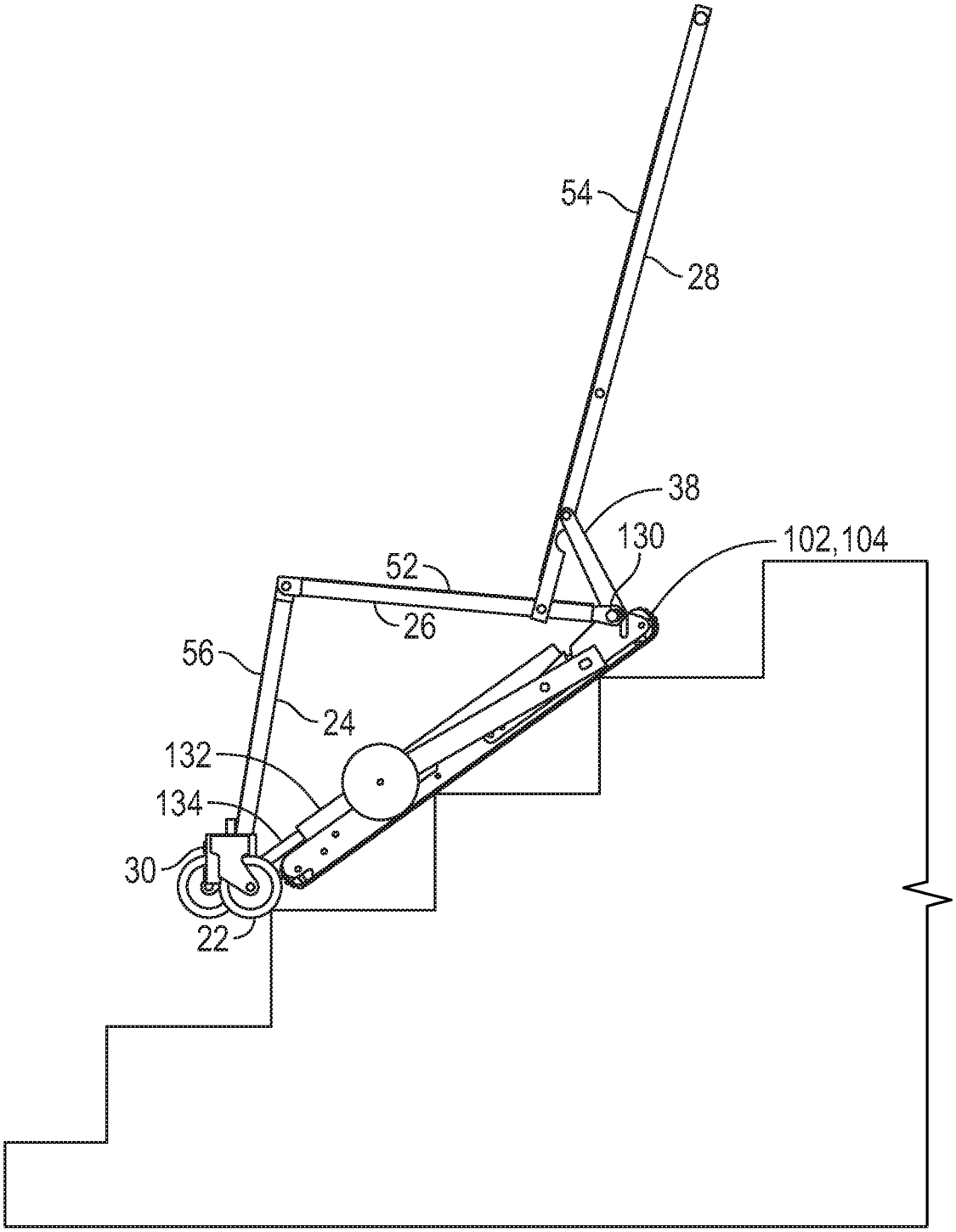
FIG. 8 is a side view of the patient transfer apparatus of FIG. 1 in a second configuration on a set of stairs, according to an exemplary embodiment.

By way of example, the apparatus 10 is shown with the track assembly 100 supported by a set of stairs in FIG. 5. As shown, the orientation of the seat 52 is near horizontal. The apparatus 10 is shown with the track assembly 100 supported by a shallower set of stairs in FIG. 8, with the seat 52 again near horizontal. In the illustrated embodiment, to maintain the orientation of the seat 52 and, by extension, the patient, on both sets of stairs, the inner telescoping members 134 are extended from the track assembly 100. Because the seat members 26 and the lower members 24 have fixed lengths, extending the inner telescoping members 134 from the track assembly 100 causes each of the lower members 24 and the respective seat members 26 to pivot away from one other (e.g., by increasing the angle between the lower members 24 and the seat members 26). It causes the seat 52 to pivot about the cross member 130, adjusting the orientation of the seat 52 and the seat back 54. In this way, the seat is configured to be self-leveling, such that the seat remains level with, or near horizontal relative to, the main support surface such as the floor or a landing. In some embodiments, the seat is pivotable relative to the track to maintain a predetermined orientation while traversing the stairs. The predetermined orientation may be a horizontal orientation or inclined within ten degrees of the horizontal orientation. In some embodiments, the extension of the inner telescoping members 134 is controllable using a mechanical means. By way of example, the operator may extend the inner telescoping member 134 with a lead screw. By way of another example, a brake may be used to selectively fix the relative position of the inner telescoping member 134 and outer telescoping member 132. In yet other embodiments, the track assembly 100 does not telescope and instead the orientation of the patient is adjusted by pivoting the track assembly 100 relative to the frame 21.

In some embodiments and with reference to FIG. 3, a length of at least one of the seat members (length 135*a*), lower members (length 135*b*), and the track assembly (length 135*c*) is adjustable to permit a change in an angle 136 between the seat at the tracks. With continued reference to FIG. 3, the seat members 26 may be pivotably coupled to the track assembly 100 at a coupling point (depicted generally as reference numeral 138), the lower members 24 may be pivotably coupled to a front end of the track assembly 100 at a coupling point (depicted generally as reference numeral 140), and the adjustable length may be the distance between the coupling points 138, 140 (i.e., length 135*c*). The apparatus 10 may include a telescoping system configured to adjust the length of the at least one of the seat members 26, lower members 24, and track assembly 100. The telescoping system may include the outer telescoping members 132 and inner telescoping members 134 described above.

Figure 9:
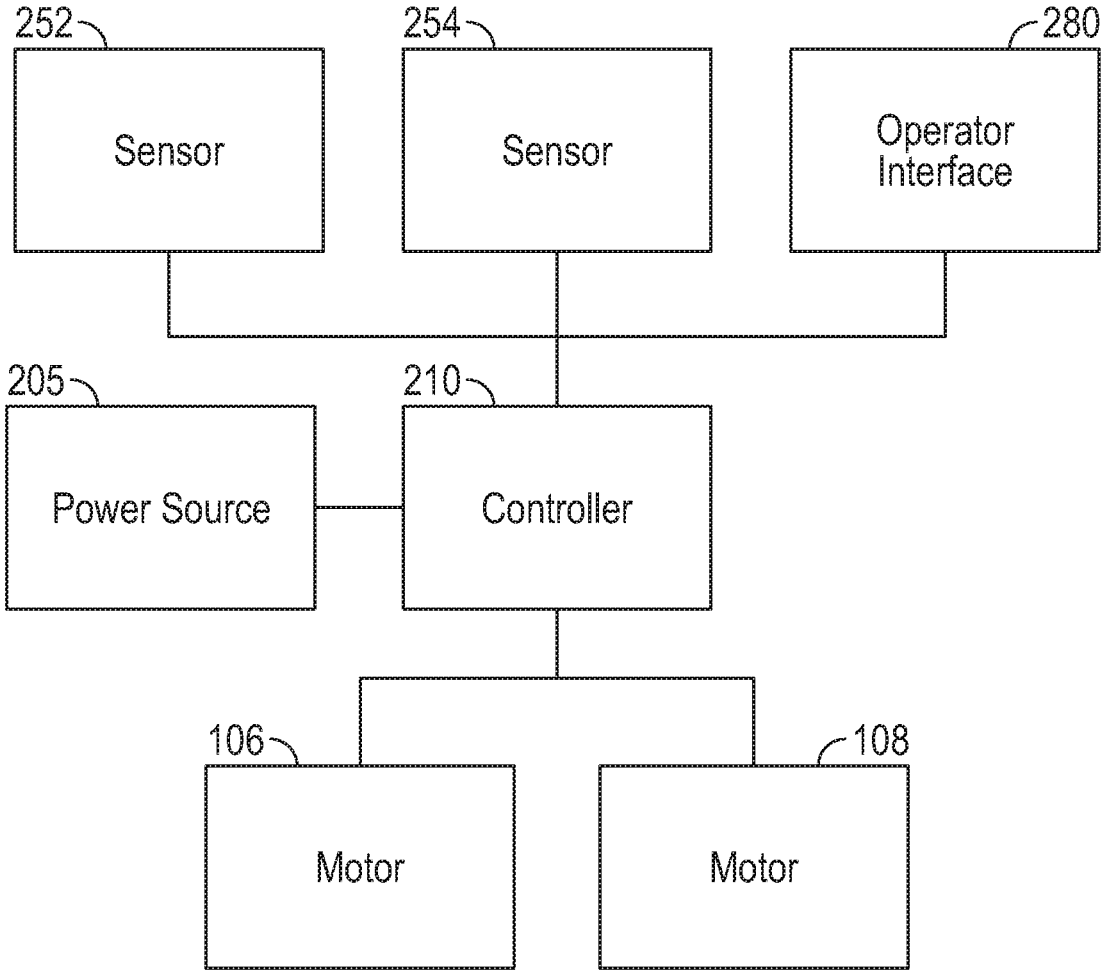
FIG. 9 is a schematic view of a control system of the patient transfer apparatus of FIG. 1, according to an exemplary embodiment.

In some embodiments, the track assembly 100 includes one or more motors, such as the motors 106 and 108, schematically shown in FIG. 9, to drive the tracks 102 and 104 and control the motion of the patient transfer apparatus 10 on the set of stairs. In some embodiments, the motor 106 is coupled (e.g., directly or indirectly) to the track 102 and the motor 108 is coupled (e.g., directly or indirectly) to the track 104. In other embodiments, only one motor is coupled to both of the tracks 102 and 104. In some embodiments, the one or more motors drive the pulleys 110 and/or the pulleys 112, which in turn drive the tracks 102 and 104. In other embodiments, the one or more motors drive the tracks 102 and 104 directly (e.g., the output of the motor 106 directly contacts the inside surface of the track 102). In some embodiments, the one or more motors drive the tracks 118 of the second stage 116 in addition to the tracks 102 and 104 (e.g., the motor 106 drives both track 102 and the track 118 closest to the track 102). In other embodiments, additional motors are used to drive the tracks 118. In some embodiments, the track assembly 100 includes only one motor operably coupled to the track 102 and the track 104, and also includes one or more clutches. These clutches allow the output of the motor to be variably distributed between the track 102 and the track 104.

In one embodiment, the motors 106 and 108 allow the apparatus 10 to traverse the set of stairs without the operator having to exert the entire force necessary to move the apparatus 10. In some embodiments, the motors provide the entire force necessary to move the apparatus up the set of stairs. In other embodiments, the motors provide a portion of the force necessary to move the apparatus 10 up the set of stairs, and the operator provides the balance. When descending the set of stairs, the motors 106 and 108 may provide a braking force to counteract the force of gravity bringing the apparatus 10 down the set of stairs. In some embodiments, the motors are configured to provide a braking force by shorting the leads of each of the motors 106 and 108, such that an external force turning the motor 106 or the motor 108 generates an electrical power that is dissipated by the respective motor 106 or motor 108. In other embodiments, the motors are driven such that the force generated by the motors counteracts some or all of the force on the apparatus due to gravity. In some embodiments, the output of the motors is varied to maintain a constant speed of the apparatus 10 on the set of stairs.

In other embodiments, the motors 106 and 108 art omitted. In some of these embodiments, the track assembly 100 includes a mechanical means for providing a braking force on the tracks 102 and 104. By way of example, there may be a rotary damper coupled to the top pulley 110 such that it provides a damping force on the track 102. In some embodiments, the mechanical braking force is applied to the track only when traveling down the set of stairs. This facilitates the operator moving the apparatus 10 up the set of stairs unhindered while providing the operator with additional control when descending the set of stairs. By way of example, the top pulley 110 may be coupled to a one-way rotary damper such that the damper provides a braking force on the track 102 only when descending the set of stairs. By way of another example, a high-friction pad may be built into the track members 114 such that the high-friction pad is selectively engageable with the inside surface of the track 102 by the operator (e.g., by toggling a lever).

The control system 200, shown according to an exemplary embodiment in FIG. 9, includes the power source 205, the controller 210, and the control interface 280. In some embodiments, the control system 200 further includes one or more sensors. The controller 210 can include a processor and a memory device. The processor can be implemented as a general purpose processor, an application specific integrated circuit (ASIC), one or more field programmable gate arrays (FPGAs), a group of processing components, or other suitable electronic processing components. The memory device (e.g., memory, memory unit, storage device, etc.) may be one or more devices (e.g., RAM, ROM, flash memory, hard disk storage, etc.) for storing data and/or computer code for completing or facilitating the various processes, layers and modules described in the present application. The memory device may include volatile memory or non-volatile memory. The memory device may include database components, object code components, script components, or any other type of information structure for supporting the various activities and information structures described in the present application. According to an exemplary embodiment, the memory device is communicably connected to processor via processing circuit and includes computer code for executing (e.g., by processing circuit and/or processor) one or more processes described herein. In some embodiments, the controller 210 includes both hardware and software. In other embodiments, the controller 210 is entirely hardware based. The controller 210 controls the motors 106 and 108 in the illustrated embodiment.

As shown in the illustrated embodiment of FIG. 9, the power source 205 is operatively coupled to all of the motors of the system (which may be only one or more than one), the controller 210, and the control interface 280 such that the power source 205 provides power at the levels necessary to operate (e.g., the correct voltage and current). In some embodiments, the power source 205 is further operatively coupled to one or more sensors. In some embodiments, the power source 205 is operatively coupled to the controller 210, and the controller 210 distributes power to the sensors and motors. In some embodiments, the power source 205 is a rechargeable electric battery. In some embodiments, there are multiple power sources 205 (e.g., one power source for each motor). In some embodiments, the power source is removable such that it can be recharged off the patient transfer apparatus 10 or replaced.

In some embodiments, the control system 200 includes the control interface 280. The control interface 280 acts as a means for receiving an input from an operator associated with a desired operation of the apparatus 10. By way of example, the operator may select the desired direction and speed of movement of the tracks 102 and 104. The control interface may incorporate one or more of a load cell, force detection, a pushbutton, a touchscreen, a joystick, twist controls, dials, knobs, temperature sensing, proximity sensing, and gesture sensing. By way of example, the control interface may incorporate a load cell into the handle 34. When the user pushes the handle 34, a positive force with respect to the direction faced by a patient is registered by the load cell, and the controller 210 controls the motors to move the apparatus 10 forward. When the user pulls on the handle 34, a negative force with respect to the direction faced by a patient is registered and the controller 210 controls the motors to move the apparatus backward. The magnitude of the force may then correspond to the desired speed of the apparatus 10 (e.g., a greater force corresponds to a greater desired speed).

Figure 4:
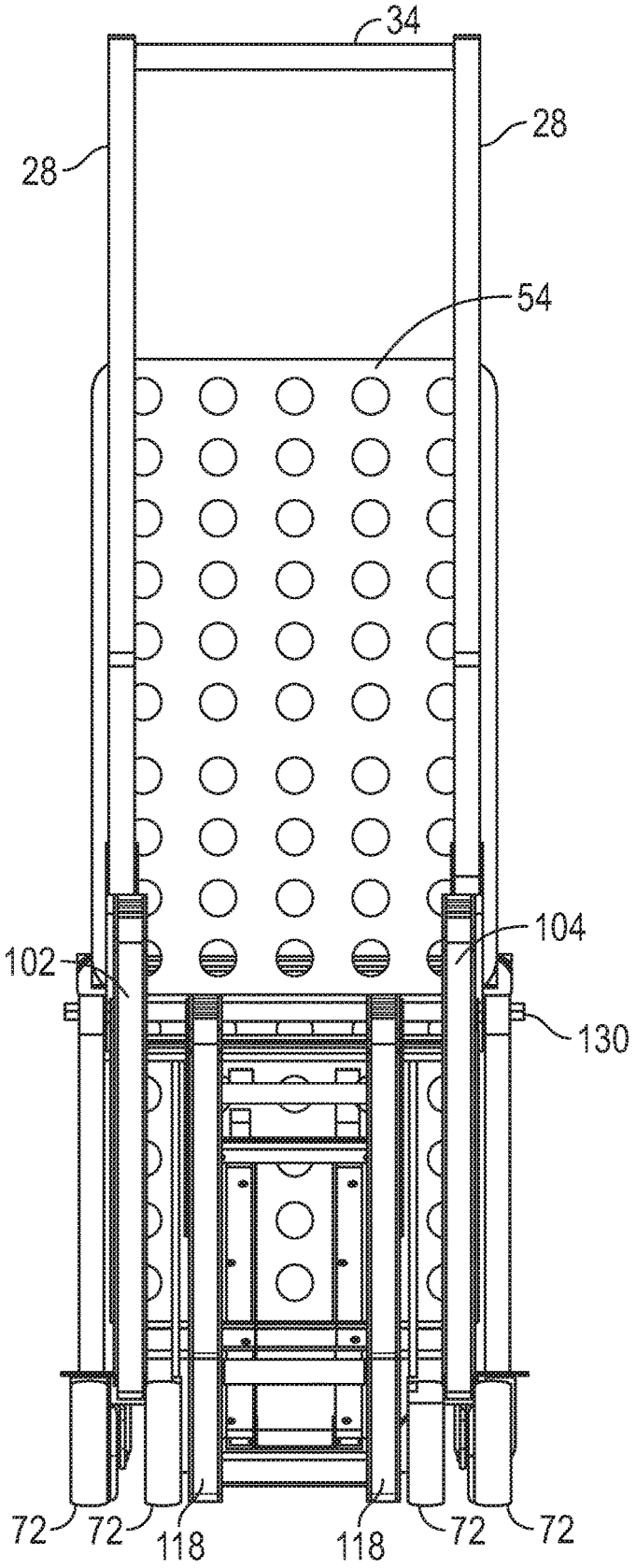
FIG. 4 is a rear view of the patient transfer apparatus of FIG. 1.

In some embodiments, when ascending a set of stairs, the apparatus 10 begins on a landing at the bottom of the set of stairs with the rear supports 70 in the transport position, shown in FIG. 4, and the patient is placed on the seat 52. In some embodiments, the patient is held in position on the apparatus 10 (e.g., using straps or belts). The rear end of the apparatus 10 may be turned to face the set of stairs. In some embodiments, the rear supports 70 are manually moved to the stair-traversing position. In other embodiments, the operator lifts the rear end of the apparatus 10 and moves the apparatus 10 towards the set of stairs, causing the rear supports 70 to retract (e.g., by means of a spring, by contacting the stairs, etc.). In some embodiments, the rear supports 70 are arranged such that the weight of the apparatus 10 holds the rear supports 70 in the transport position until the apparatus 10 is lifted. Once the rear supports 70 have been retracted, the operator moves the apparatus 10 so that the track assembly 100 is contacting the set of stairs.

In some embodiments, once the track assembly 100 contacts the set of stairs, controller 210 begins running the motors 106 and 108 to drive the apparatus 10 up the set of stairs. In some embodiments, the motors 106 and 108 are activated when the operator interacts with the interface 280, indicating that he/she is ready to begin ascending the set of stairs. In other embodiments, the apparatus 10 is manually moved up the set of stairs by the operator. An exemplary embodiment of the apparatus 10 fully supported by the set of stairs is shown in FIG. 5. Once the center of gravity of the patient and the apparatus 10 crosses the tread edge of the top stair, the apparatus may pivot about the contact point between the top stair and the track assembly 100, and the operator supports the rear end of the apparatus. In some embodiments, the operator continues to support the rear end of the apparatus 10 until there is sufficient clearance for the rear support 70 to rotate back to the transport position. In some embodiments, a biasing force (e.g., from a spring) brings the rear support 70 back to the transport position. In some embodiments, the rear support 70 is moved into the transport position manually by the operator. The apparatus 10 is then moved completely off the set of stairs to a landing at the top of the set of stairs where it may be fully supported by the wheels 22 and the wheels 72.

In some embodiments, when descending a set of stairs, the apparatus 10 begins on the landing at the top of the set of stairs with the rear supports 70 in the transport position, shown in FIG. 4, and the patient is placed on the seat 52. In some embodiments, the patient is held in position on the apparatus 10 (e.g., using straps or belts). The front end of the apparatus 10 is positioned to face the set of stairs. The rear supports 70 are then retracted into the stair-traversing position. Once the rear supports 70 have been retracted, the operator may move the apparatus 10 so that the track assembly 100 is contacting the set of stairs.

In some embodiments, the motors 106 and 108 are activated to provide a braking force when the operator interacts with the interface 280, indicating that he/she is ready to begin descending the set of stairs. In some embodiments, a braking force is applied mechanically as previously discussed. The apparatus 10 may then be guided down the set of stairs by the operator. In some embodiments, once the front wheels of the apparatus contact the landing at the bottom of the set of stairs, the operator supports the weight of the rear end of the apparatus 10 while moving the apparatus away from the set of stairs. While the apparatus moves away from the set of stairs, the rear supports 70 are returned to the transport position. Once the rear supports 70 are in the transport position, the operator can lower the apparatus 10 onto the wheels 22 and the wheels 72.

In some situations, the orientation of the apparatus 10 on the set of stairs may need to be adjusted while traversing the set of stairs (i.e., the apparatus 10 may need to be steered). By way of example, a set of stairs may include a curved section. By way of another example, the operator may not initially align the apparatus 10 correctly to achieve the desired path on the set of stairs. In some embodiments, the motor 106 and the track 102 are controlled independently of the motor 108 and the track 104. By way of example, the controller 210 may be configured to control the track 102 to move at a first speed and the track 104 to move at a second speed different from the first speed. To correct the path of travel of the apparatus 10, the relative speeds of the tracks 102 and 104 can be varied. When the apparatus 10 uses motor 106 to drive the track 102 and motor 108 to drive the track 104, the two motors 106 and 108 can be driven at different speeds to allow for steering the apparatus 10 left and right on the set of stairs without the operator having to lift the apparatus 10. This facilitates the use of the apparatus 10 on sets of stairs with various layouts (e.g., spiral staircases, straight staircases, etc.).

In some embodiments, the operator controls the speed of the motors 106 and 108 using the control interface 280. In some embodiments, the control interface 280 is configured to receive a desired speed of the track 102 and a desired speed of the track 104, and the controller 210 is configured to control the motor 106 and the motor 108 to operate at the respective desired speeds. By way of example, the control interface 280 may include a load cell on each side of the handle 34. The load cells may be used to determine the magnitude and direction of the force on each side of the handle 34 by the operator. Upon ascending the stairs, if the operator pulls harder on the right side of the handle than the left side, it may cause the controller 210 to control the motor 108 on the right side to drive faster than the motor 106 on the left side, which would turn the apparatus 10 to the left. In some embodiments, the braking force on the track 102 and the track 104 is varied by the operator to allow for steering. By way of example, the operator may engage a brake on the track 102 but not on the track 104 while the operator is pulling the apparatus 10 up the stairs. The apparatus would then begin turning relative to the track 102 without the operator having to lift the apparatus 10. In other embodiments, the apparatus includes a sensor 252 to determine the current trajectory of the patient transfer apparatus, and controls the speed of the track 102 and the track 104 based on the current trajectory. Sensor 252 is operatively coupled to the controller 210, as shown in FIG. 9. In some embodiments, the sensor 252 is an accelerometer. By way of example, the sensor 252 may be used to determine the current orientation of the apparatus (e.g., the orientation with respect to the direction of gravity vector), and the current orientation may be used to determine the speed at which to run the motors 106 and 108.

In some embodiments, for traversing the set of stairs, the position of the seat assembly 20 is adjusted to position the patient in a consistent orientation regardless of the incline of the set of stairs. In some embodiments, this orientation leaves the patient in a comfortable and safe position (e.g., an upright-seated position, a reclined position, a position resulting from a substantially horizontal orientation of the seat, etc.). In some embodiments, the operator can adjust the orientation of the patient. By way of example, the seat 52 may be positioned using a crank that extends and contracts the inner telescoping member 134 of the track assembly 100. In some embodiments, the seat assembly 20 maintains the position of the patient passively. By way of example, the seat assembly 20 may be coupled to the track assembly by means of a gimbal. The gimbal may include a brake such that the seat assembly 20 can freely rotate to achieve the desired orientation, and the brake can be applied to maintain the orientation.

In some embodiments, the orientation of the seat 52 is adjusted in order to affect the stability of the apparatus. If the patient is located on the seat 52 in a fixed orientation (e.g., the back of the patient is pressed against the seat back 54 which is fixed relative to the seat 52), then adjusting the orientation of the seat 52 moves the center of gravity of the patient. The center of gravity of the patient can be moved to minimize the gravitational forces that produce a tipping moment on the apparatus 10 (e.g., by moving the center of gravity of the patient above the center of the track assembly 100). In some embodiments, the seat 52, the seat back 54, and the lower leg rest 56 are articulated to control the position of the center of gravity of the patient.

In some embodiments, the movement of the rear supports 70 and the extension of the inner telescoping member 134 from the track assembly 100 are motorized. In a set of these embodiments, the controller 210 is configured to control the movement of the rear supports 70 and the inner telescoping member 134 in response to input from additional sensors. By way of example, the controller 210 may control the movement of the rear supports 70 from the transport position to the stair-traversing position. By way of another example, the controller 210 may control the orientation of the seat 52 to optimize the stability of the apparatus 10 or to maintain a consistent orientation of the seat 52 regardless of the orientation of the track assembly 100. In some embodiments, an additional sensor 254 detects the orientation of the seat 52 with respect to the direction of gravity, and the controller 210 extends or retracts the inner telescoping member 134 to adjust the orientation of the seat assembly 20. In some embodiments, the sensor 254 is an accelerometer or inclinometer operably coupled to the controller 210. By way of example, if the sensor 254 detects that the seat 52 is outside an acceptable orientation range (e.g., 0 degrees to 10 degrees from horizontal), the controller 210 adjusts the orientation of the seat 52 in order to bring the orientation back within the acceptable range.

As discussed herein, the seat 52 may be oriented such that the patient maintains a certain desired orientation while traversing (i.e., ascending or descending) the set of stairs. In some embodiments, this orientation is similar to the orientation when in the transport configuration. In other embodiments, the orientation changes to tip the patient back slightly (e.g., 2 degrees from level, 5 degrees from level, etc.) so gravity holds the patient on the patient transfer apparatus 10. Depending on how steep the set of stairs is, the angle between the seat 52 and the track 102, 104 required to achieve this desired orientation may change. In some embodiments, the seat 52 is self-leveling using the controller 210 to maintain the desired orientation of the seat 52. In some embodiments, a nominal target value for the angle between the seat 52 and the tracks 102, 104 is predetermined to achieve the desired orientation for an average set of stairs, and the controller 210 uses feedback from sensors to determine how to control the motor to achieve the target angle. In other embodiments, feedback from the sensor 254 is used by the controller 210 to determine the actual orientation of the seat 52 relative to the direction of gravity, and the controller 210 controls motor to adjust an angular position of the seat relative to the track 102, 104 to achieve a desired orientation. Adjusting the position of the seat 52 in this way ensures that the patient will experience the same target orientation regardless of the steepness of the stairs being traversed. In some embodiments, the controller 210 continuously monitors the actual orientation of the seat 52 and controls the motor to bring the seat 52 to the desired orientation. In some embodiments, the operator can manually adjust the angle between the seat 52 and the track 102, 104. In some embodiments, the operator manually controls the motor. In some embodiments, the predetermined orientation is a fixed value. In other embodiments, the predetermined orientation is a dynamic value based on, for example, a condition of the stairs and/or the of the patient. Adjusting the apparatus such that the seat 52 moves to or maintains the predetermined orientation is also described in U.S. patent application Ser. No. 15/854,943, entitled PATIENT TRANSFER APPARATUS WITH INTEGRATED TRACKS, filed concurrently herewith on Dec. 27, 2017, which is hereby incorporated by reference in its entirety.

The terminology used in this disclosure is for the purpose of description only and should not be regarded as limiting. Further, the construction and arrangement of the apparatuses, systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, some elements shown as integrally formed may be constructed from multiple parts or elements, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products having machine-readable media for carrying or having machine-executable instructions or data structures stored thereon. Such machine-readable media can be any available media that can be accessed by a general purpose or special purpose computer or other machine with a processor. By way of example, such machine-readable media can include RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

What is claimed is:

1. A patient transfer apparatus comprising:

a seat assembly including a frame and a seat for supporting a patient;

a track assembly coupled to the seat assembly and including a first stage and a second stage, wherein the first stage includes a track defining an angle with the seat to engage stairs in a stair traversing position, wherein the second stage is capable of telescoping relative to the first stage to adjust the angle; and front wheels coupled to the seat assembly for engagement with a floor in a transport position, wherein a front end of the track assembly is adjacent the front wheels without interfering with movement of the front wheels in the transport position.

2. The apparatus of claim 1, further comprising a rear support coupled to at least one of the track assembly and seat assembly, wherein the rear support is moveable relative to the seat assembly between the transport position and the stair traversing position such that the rear support engages the floor in the transport position.

3. The apparatus of claim 2, wherein the rear support comprises a rear wheel disposed at a distal end thereof for engagement with the floor in the transport position.

4. The apparatus of claim 1, wherein at least a portion of the track is positioned under the seat at the angle relative to the seat in the transport position.

5. The apparatus of claim 1, wherein a first span of the first stage is greater than a second span of the second stage.

6. The apparatus of claim 5, wherein at least a portion of the second stage is positioned between the front wheels.

7. The apparatus of claim 5, wherein the first stage includes a second track, wherein the tracks are positioned parallel to one another at a first separation distance.

8. The apparatus of claim 7, wherein at least a portion of the second stage is between the tracks.

9. The apparatus of claim 5, wherein at least a portion of the second stage extends beyond the first stage in at least one of the transport and stair traversing positions to increase an overall length of the track assembly.

10. The apparatus of claim 5, wherein the first and second stages are pivotably coupled to the seat assembly such that the first and second stages pivot together relative to the seat assembly.

11. The apparatus of claim 5, wherein the second stage includes a track.

12. A patient transfer apparatus comprising:

a seat assembly including a frame and a seat for supporting a patient;

a track assembly coupled to the seat assembly and including a track configured to engage stairs in a stair traversing position;

front wheels coupled to the seat assembly for engagement with a floor in a transport position, wherein a front end of the track assembly is adjacent the front wheels without interfering with movement of the front wheels in the transport position; and a rear support pivotally coupled to the track assembly, wherein the rear support is moveable relative to the seat assembly and the track assembly between the transport position and the stair traversing position such that the rear support engages the floor in the transport position and permits the track to engage the stairs in the stair traversing position, wherein the rear support comprises a rear wheel disposed at a distal end thereof for engagement with the floor in the transport position.

13. The apparatus of claim 12, wherein at least a portion of the track is positioned under the seat at an angle relative to the seat in the transport position.

14. The apparatus of claim 12, wherein the track assembly includes a first stage and a second stage, wherein a first span of the first stage is greater than a second span of the second stage.

15. The apparatus of claim 14, wherein at least a portion of the second stage is positioned between the front wheels.

16. The apparatus of claim 14, wherein the first stage includes the track and a second track, the tracks being positioned parallel to one another at a first separation distance.

17. The apparatus of claim 16, wherein at least a portion of the second stage is between the tracks.

18. The apparatus of claim 14, wherein at least a portion of the second stage extends beyond the first stage in at least one of the transport and stair traversing positions to increase an overall length of the track assembly.

19. The apparatus of claim 14, wherein the first and second stages are pivotably coupled to the seat assembly such that the first and second stages pivot together relative to the seat assembly.

20. The apparatus of claim 14, wherein the second stage includes a track.

* * * * *